US005437251A

United States Patent [19]

Anglim et al.

[11] Patent Number: 5,437,251

[45] Date of Patent: Aug. 1, 1995

[54] TWO-WAY ROTARY SUPERCHARGED, VARIABLE COMPRESSION ENGINE

[76] Inventors: Richard R. Anglim; Hazel L. Halfman, both of 8880 SW. 27th Ave., #B-68, Ocala, Fla. 32674

[21] Appl. No.: 243,408

[22] Filed: May 16, 1994

[51] Int. Cl.[6] ..... F01L 11/00

[52] U.S. Cl. ..... 123/56.3; 123/58.5; 123/65 S

[58] Field of Search ..... 123/58.5, 58.6, 65.5, 123/47 R, 47 A, 56.1, 56.3

[56] References Cited

U.S. PATENT DOCUMENTS

| | | | |
|---|---|---|---|
| 1,115,481 | 11/1914 | Bachle et al. | 123/58.5 |
| 1,229,009 | 6/1917 | Allison | 74/56 |
| 1,764,329 | 6/1930 | Martin | 123/58.6 |
| 1,864,248 | 6/1932 | Holmes | 74/57 |
| 2,058,505 | 10/1936 | Reno | 123/58.5 |
| 2,403,282 | 7/1946 | Holmes | 123/58 |
| 3,006,324 | 10/1961 | Shaw | 74/60 |
| 3,996,903 | 12/1976 | Cseh | 123/58.5 |
| 4,250,844 | 2/1981 | Tews | 123/47 A |
| 4,449,489 | 5/1984 | Williams | 123/48 R |
| 4,515,113 | 5/1985 | DeLorean | 123/48 C |
| 5,261,358 | 11/1993 | Rorke | 123/47 R |

FOREIGN PATENT DOCUMENTS

| | | | |
|---|---|---|---|
| 90/12952 | 11/1990 | WIPO | 123/58.5 |

*Primary Examiner*—David A. Okonsky
*Attorney, Agent, or Firm*—Edward M. Livingston

[57] ABSTRACT

A variable-compression internal-combustion engine has a two-stage cylinder with a relatively large diameter at a first-stage, supercharge end, which is also a power-takeoff end, than at a second-stage, combustion end of the cylinder. Intake air is drawn into the first-stage, supercharge end of the cylinder by a matching larger-diameter, first-stage, supercharge end of a two-stage piston during a compression stroke of a two-stroke cycle of the two-stage piston. During a power stroke, intake air is directed into and contained under pressure in an air-transfer passage that is positioned circumferentially and externally around an outside periphery of a bottom end of the first-stage cylinder. At a bottom end of the power stroke, intake air is directed from the air-transfer passage into a transfer conveyance extended from the supercharge end to tile second-stage head of the two-stage piston where the intake air is venturi-accelerated to the second-stage head of the two-stage cylinder while exhaust escapes through exhaust ports at a bottom of the second stage of the two-stage cylinder. Cylinder heads can be variable in distance from top dead center of piston travel to regulate compression ratio as desired for different operating conditions. Reciporcative travel of a plurality of the two-stage pistons is convened to rotary motion preferably by a pinch plate in working relationship to an angled cam plate. The pinch plate cam-drives the angled cam plate with a large contact surface for long wear life. Other rotational means can be employed.

15 Claims, 4 Drawing Sheets

FIG. 3
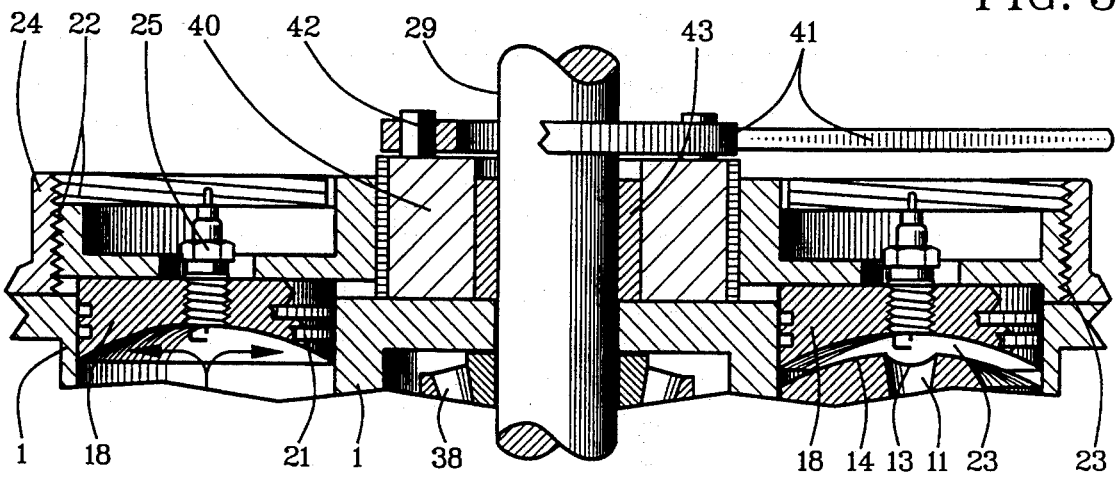
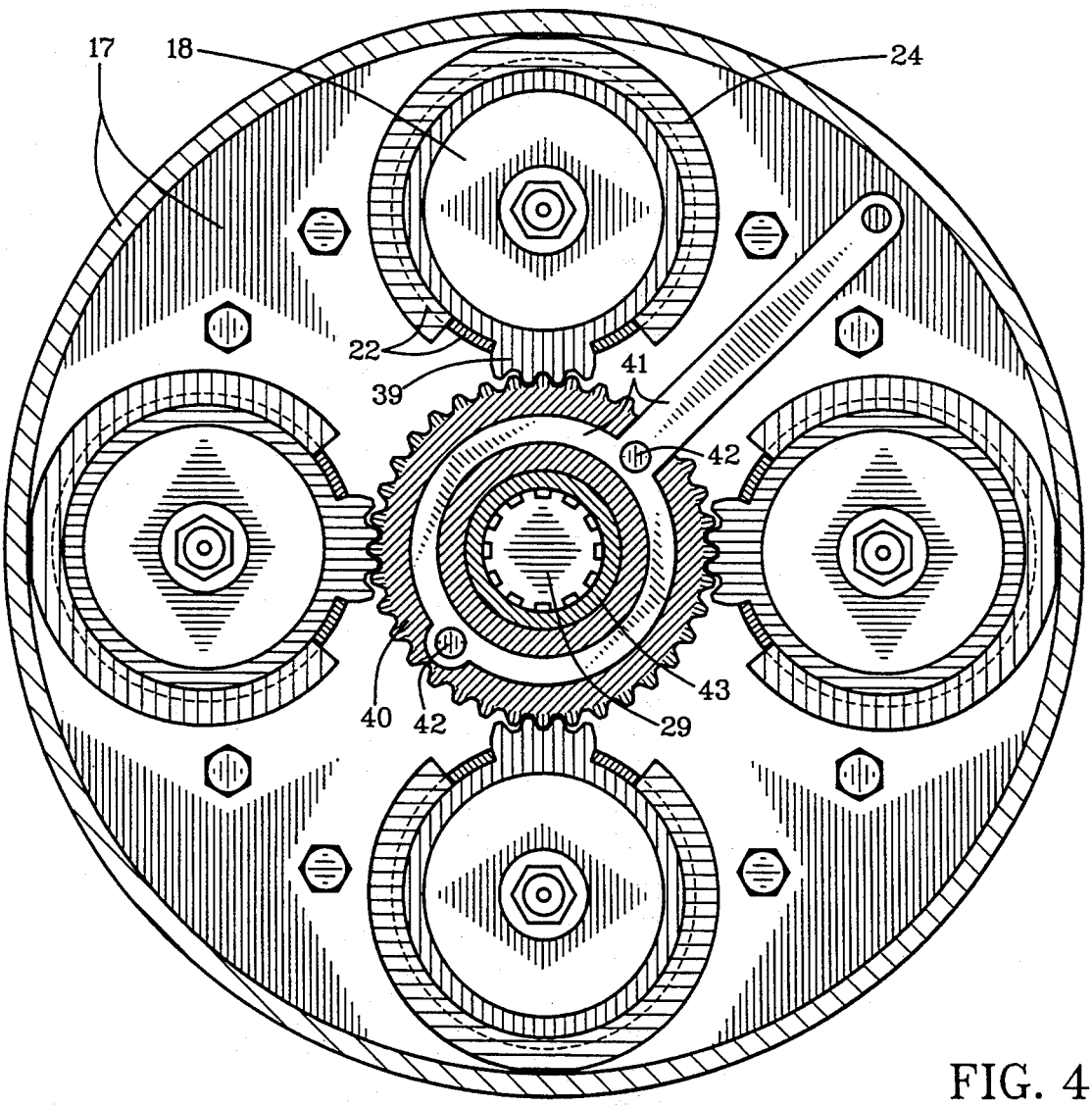
FIG. 4

TWO-WAY ROTARY SUPERCHARGED, VARIABLE COMPRESSION ENGINE

BACKGROUND OF THE INVENTION

1. Field of the Invention

This invention relates to two-stroke-cycle internal-combustion engines having pistons and cylinders larger in diameter at a supercharge section than at a combustion section in order to provide supercharged intake air to a combustion end and an expandable combustion chamber to provide variable compression ratio in working relationship with either various forms of swash-plate or a crankshaft means for converting reciprocative travel of pistons to rotational power output.

2. Description of Related Art

One of the problems with present two-stroke-cycle internal-combustion engines is incomplete scavenging of exhaust gases before intake air enters cylinders for compression. This decreases the amount of unused air available for thorough combustion. Another problem is volumetric inefficiency of compression by not drawing in a full cylindrical volume of air for compression. Another problem applicable to carbureted two-cycle engines is losing fuel mixed with air through exhaust ports in two-cycle scavenging systems. Still another problem is the premixing of fuel with lubricant made necessary by loss of lubricant through exhaust ports if supplied at rings as in four-stroke-cycle engines.

Swash-plates are a form of cam drive. They have been known longer than crankshaft engines and there are more patents on various types of cam-drive engines than on any other type of engine. Swash-plate engines are referred to also as round engines or barrel engines. In physical principle, however, the crankshaft engine also is a cam-drive engine when considering action of a piston against a cylinder wall.

It has long been known that the swash-plate type of cam drive can be more efficient than the crankshaft type of cam drive due largely to cyclical, low leverage of crankshaft drives. Before the advent of turbine engines for aircraft use, considerable research and analysis was done in relation to piston engines for propeller propulsion. Being considered then were various types of swash-plate engines as explained in a paper presented to the Society of Automotive Engineers by E. S. Hall on Mar. 14, 1940. Swash-plate engines were recommended as having greater potential advantages than crankshaft engines, even though there were some problems with swash-plate engines that had not yet been solved. Many problems have been solved for swash-plate and crankshaft engines since then and many mentioned in that paper had already been solved but were not acknowledged.

This invention provides major mechanical and thermodynamic improvements to both swash-plate engines and to crankshaft engines. New and better working relationships of parts are employed for solving the above problems of internal-combustion engine systems.

Variable combustion also has been known since the early days of engines. However, means for achieving variable compression have been complex and so costly that their advantages have not been utilized.

Referring to the cited prior art patent documents, DeLorean employed a swash-plate with a pivotal cam-follower the same as taught by the Shaw patent in 1961 for converting reciprocative travel of pistons to rotational power of an output shaft. This was a major improvement over single-point contact of other swash-plate devices. It made use-life competitive with other drive systems under the high-pressure and impact conditions of combustion in an engine. Previously cam drives had been acceptable for only low-pressure conditions in such mechanisms as the swash-plate compressor for refrigeration and air conditioning currently being used by major car manufacturers. DeLorean also taught linear movement of a cylinder head with a fluid controlled by a ball valve for regulating compression ratio. But that patent did not teach supercharged compression, nor was it possible to achieve supercharge compression with that engine in the efficient manner that is taught by Applicant. In addition, the fluid method for controlling compression ratio was expensively complicated to achieve in conjunction with adequate cooling of the cylinder head for the engine system in which it was employed.

The Williams patent taught regulation of compression ratio in a crankshaft engine by means of a screw-jack device positioned centrally in a plurality of cylinder heads and operable by a common worm shaft. Spark plugs were insertable through a central channel in the screw of the screw jack with an extension wrench. The Williams patent was limited to valve-in-head cylinders typically used for 4-stroke-cycle engines. A device employing geared threading in this invention is positioned outside of a cylinder head in a manner that it is easier to operate, less expensive, does not interfere with placement of spark plugs and does not inhibit cooling of cylinder heads where dissipation of engine heat is most critical.

The Shaw patent taught a pivotal cam-follower for a swash-plate engine. It is referenced here primarily to demonstrate public domain of this particular feature that is employed in the DeLorean patent.

Both of the Holmes patent and the Allison patent are referenced only to demonstrate prior swash-plate art. They do not teach either a supercharge system nor a regulator of compression ratio for a two-stroke combustion cycle as taught by this invention.

SUMMARY OF THE INVENTION

One objective of this invention is to provide complete, clean and fast scavenging of a two-stroke cycle engine.

Another objective is to provide supercharge air supply for an internal-combustion engine.

Another objective is to provide variable compression ratio for an internal-combustion engine.

Another objective is to provide high horsepower output per weight of an internal-combustion engine.

Another objective is to provide low frontal drag linearly to a power-takeoff shaft of an internal-combustion engine.

Still another objective of this invention is to eliminate need for mixing of oil and fuel for a two-stroke-cycle internal-combustion engine.

This invention accomplishes the above and other objectives with an internal-combustion engine having a two-stage cylinder with a relatively large diameter at a first-stage, supercharge end which is also a power-takeoff end than at a second-stage, combustion end of the cylinder. Intake air is drawn into the first-stage, supercharge end of the cylinder by a matching larger-diameter, first-stage, supercharge end of a two-stage piston during a compression stroke of a two-stroke cycle of the two-stage piston. During a power stroke, intake air is directed into and contained under pressure in an air-transfer passage that is positioned circumferentially external around an outside periphery of a bottom end of the first-stage cylinder. At a bottom end of the power stroke, intake air mixed with atomized fuel for Otto-Cycle combustion and not mixed with fuel for Diesel-Cycle combustion is directed from the air-transfer passage into a transfer conveyance extended from the supercharge end to the second-stage head of the two-stage piston where the intake air is venturi-accelerated to the second-stage head of the two-stage cylinder while exhaust escapes through exhaust ports at a bottom of the second stage of the two-stage cylinder. Cylinder heads can be variable in distance from top dead center of piston travel to regulate compression ratio as desired for different operating conditions. Reciporcative travel of a plurality of the two-stage pistons is converted to rotary motion preferably by a pinch plate in working relationship to an angled cam plate by ball ends of shafts from the two-stage pistons. The pinch plate cam-actuates an angled cam plate with a large contact surface for long wear life. Crankshaft systems and other forms of cam drives can be employed for rotational power take-off.

BRIEF DESCRIPTION OF THE DRAWINGS

FIG. 3 is a cutaway view of a head section with geared threading of cylinder heads rotated by a sun gear for adjustment of compression ratio;

FIG. 4 is a top view of the FIG. 3 illustration;

DESCRIPTION OF PREFERRED EMBODIMENT

Figure 1:
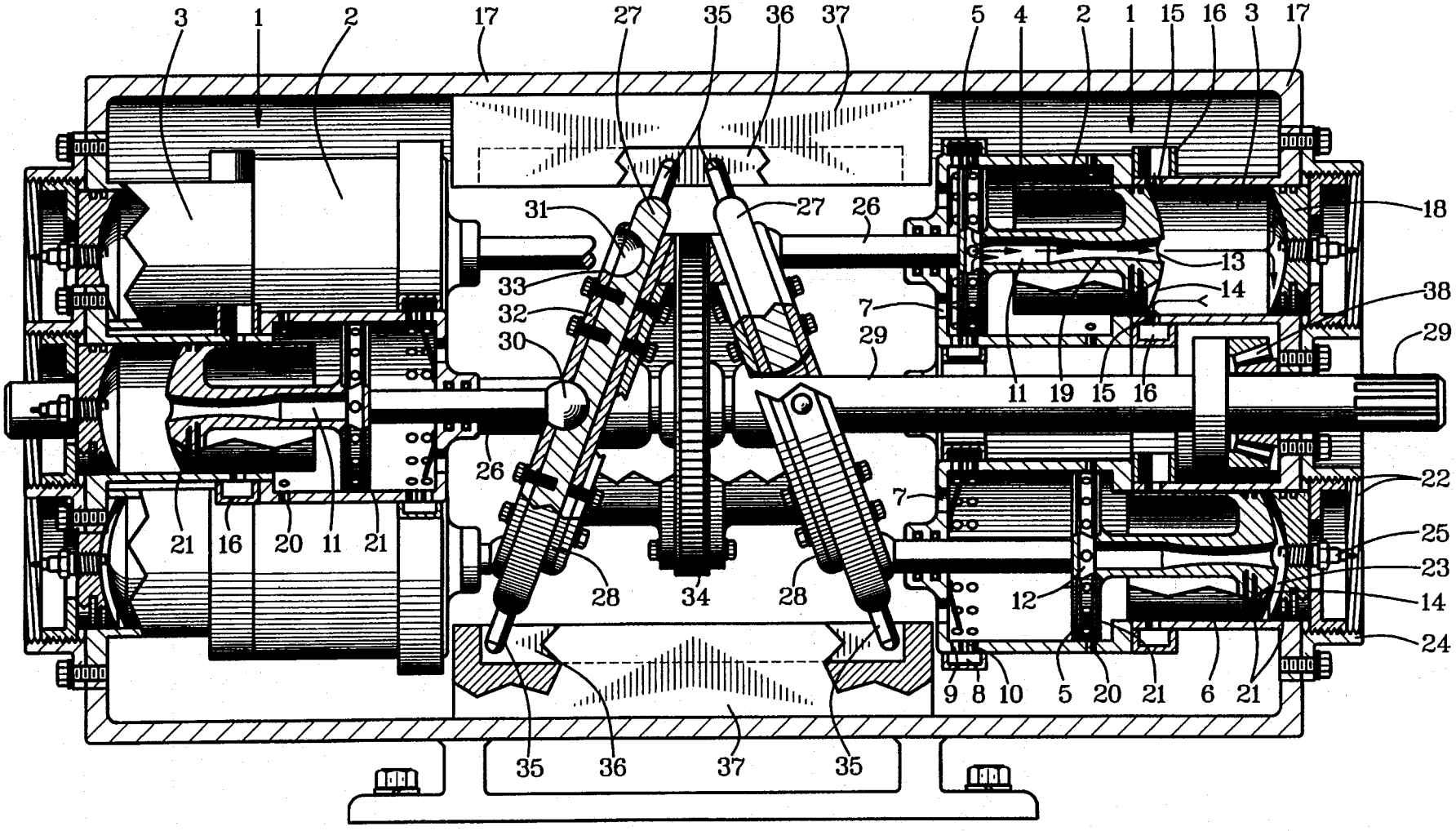
FIG. 1 is a cutaway side view.

Reference is made first to FIG. 1. A cylinder 1 has a supercharge section 2 of the cylinder at a supercharge end and a power section 3 of the cylinder at a power end of the cylinder 1. The supercharge section 2 of the cylinder has a larger diameter than the power section 3 of the cylinder. A piston 4 has a supercharge section 5 of the piston in sliding-seal contact with the supercharge section 2 of the cylinder 1 and a power section 6 of the piston in sliding-seal contact with the power section 3 of the cylinder 1. Diameters of the supercharge section 2 of the cylinder 1, the power-section 3 of the cylinder 1, the supercharge section 5 of the piston and the power section 6 of the piston are designed to provide a design level of supercharge at the supercharge section 2 of the cylinder 1 for the power section 3 of the cylinder 1.

Intake air is drawn first into the supercharge section 2 of the cylinder 1 through one-way-inlet-valved ports 7 at a bottom of the cylinder 1 during compression strokes of the piston 4. During power strokes of the piston 4, the intake air in the supercharge section 2 of the cylinder 1 is first compressed into a transfer channel 8 that is positioned circumferentially at an outside periphery of a bottom end of the supercharge section 2 of the cylinder 1. During power strokes of the piston 4, air trapped in the supercharge section 2 of the cylinder 1 is directed into the transfer channel 8 through transfer-channel inlet ports 9 and transfer-channel outlet ports 10 that are positioned in fluid communication between the transfer channel 8 and supercharge section 2 of the cylinder 1. As the supercharge section 5 of the piston 4 approaches a bottom of the supercharge section 2 of the cylinder 1, compressed air in the transfer channel 8 is directed from the transfer-channel outlet ports 10 into an intake-air conveyance 11 in the piston 4 while continuing to be directed from the supercharge section 2 to the transfer channel 8. A piston transfer channel 12 conveys the intake air from the transfer-channel outlet ports 10 to the intake-air conveyance 11 in the piston 4. Intake air from the intake-air conveyance 11 is discharged from a cylinder inlet port 13 that is positioned centrally in a piston head 14.

Exhaust is directed out of the power section 3 of the cylinder 1 through exhaust ports 15 and into exhaust outlets 16 for desired conveyance from an engine housing 17. The intake-air conveyance 11 directs the intake air linearly through the cylinder inlet port 13 towards a linearly-adjustable cylinder head 18 while exhaust gases are being discharged radially from a bottom of the power section 3 of the cylinder 1. A venturi throat 19 can be provided in the intake-air conveyance 11 to venturi-accelerate the intake air in order to assure its thorough transfer to a top portion of the power section 3 of the cylinder 1 while the exhaust gases are being discharged radially from the exhaust ports 15 at exhaust ends of power strokes of a supercharged two-stroke combustion cycle. The power section 6 of the piston 4 can be lubricated through a lubrication port 20 that can be positioned as designed in the cylinder 1.

The linearly-adjustable cylinder head 18 can have geared threads 22 with which the linearly-adjustable cylinder head 18 is adjustable linearly in nearness to the piston head 14 to achieve variable compression in a combustion envelope 23 between the piston head 14 and the linearly-adjustable cylinder head 18 when the piston head 14 is at a compression end of power strokes. Variable compression allows adjustment for high compression under starting conditions, at high altitudes, for various types of fuels and for various types of use conditions. Matching geared threads 22 can be provided in a cylindrical outside periphery of the linearly-adjustable cylinder head 18 and in an inside periphery of a cylindrical extension 24 from the cylinder 1.

An ignition means proximate the linearly-adjustable cylinder head 18 can be a spark plug 25 as shown, a diesel-fuel injector under sufficiently high-compression conditions or a glow plug under appropriate pressure conditions for particular fuels.

Rotary motion is transferred from reciprocative travel of the piston 4 through a piston shaft 26. Rotation can be achieved with a cam-drive system, a crankshaft system or other mechanical means. A cam-drive system is preferable.

The preferred cam drive has a pinch plate 27 in sliding contact with an angled cam plate 28 that is attached centrally at an angle to a power-output shaft 29. Shaft balls 30 on ends of the piston shafts 26 are positioned in hemispherical ball sockets 31 in the pinch plate 27 at positions concentric with one or a plurality of pistons 4 and piston shafts 26. A retainer plate 32 having shaft orifices 33 smaller in diameter than the hemispherical ball sockets 31 and larger in diameter than the piston shafts 26 is attached to the pinch plate 27 to maintain the shaft balls 30 in the hemispherical ball sockets 31.

First and second pinch plates 27 can be in sliding contact with first and second angled cam plates 28 for transfer of reciprocative power from oppositely-disposed pistons 4. The angled clam plates 28 can have equal angles from perpendicularity with the power-output shaft 29. This provides counterbalanced reciprocative travel of pistons that are positioned concentrically in line at circumferential positions about the power-output shaft 29 and positioned also at opposite sides diametrically from the power-output shaft 29. Starting rotation can be provided through a starter gear 34 positioned on the power-output shaft 29.

The first and second pinch plates 27 and the pistons 4 are maintained in a desired area of travel by a pinch-plate guide means. The pinch-plate guide means can include a plurality of guide rods 35 extended radially from the pinch plates 27 into sliding contact with guide slots 36 in guide members 37 that are positioned circumferentially to wobbling travel of the pinch plates 27. The guide members 37 can be attached to the engine housing 17.

The power-output shaft 29 can be provided with appropriate bearings 38 to arrest reciprocating travel from piston action on the pinch plates 27 and angled cam plates 28 while allowing rotation of the power-output shaft 29. A roller type of linear and thrust bearing in combination with a thrust ring on the power-output shaft as shown, for instance, can be positioned proximate opposite ends of the engine housing 17 to achieve this objective.

Figure 2:
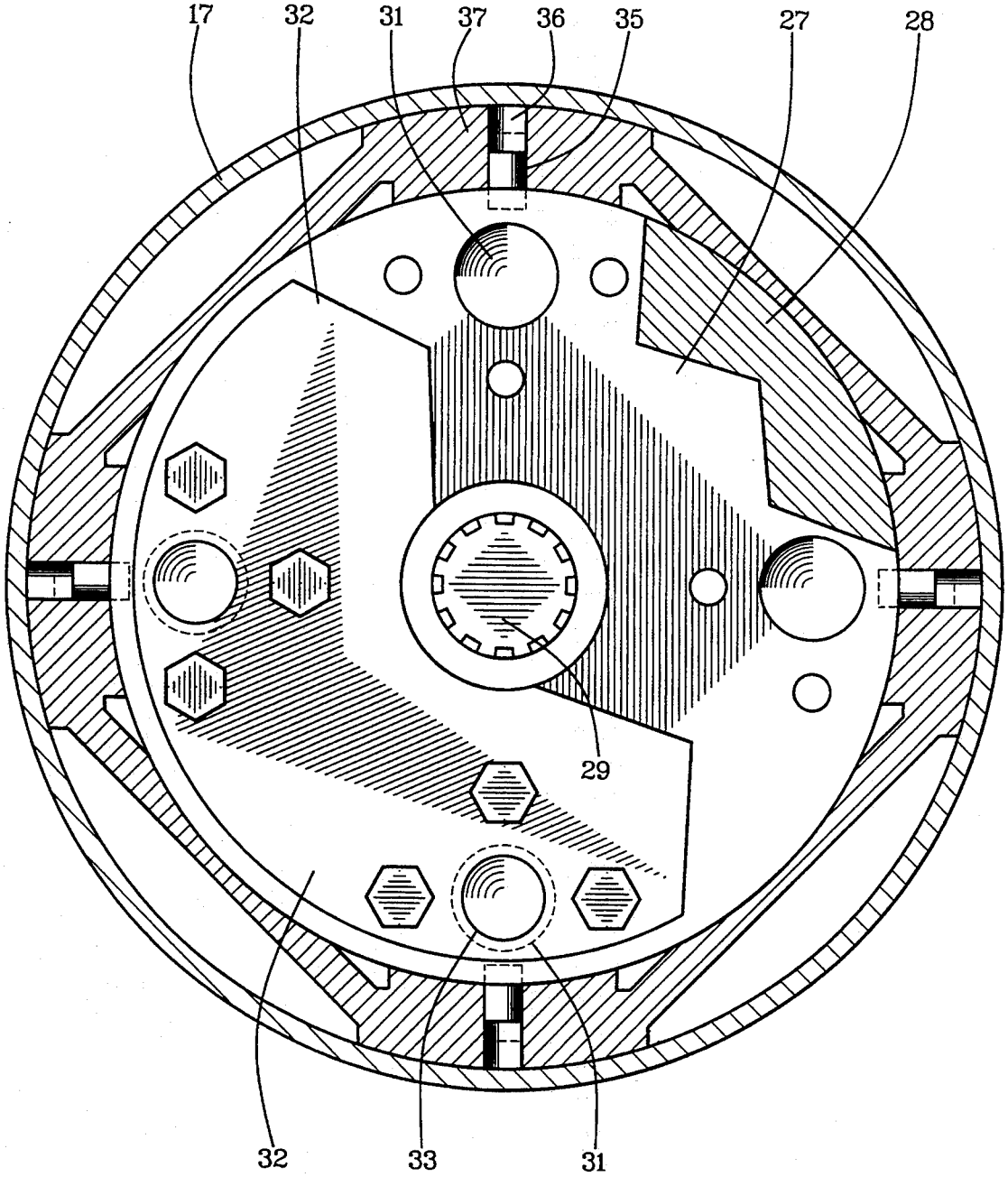
FIG. 2 is a top view of a pinch plate superimposed on an angled plate attached centrally to an output shaft that is positioned centrally in an engine housing.

Reference is made here to FIG. 2. A retainer plate 32 is attached to a pinch plate 27 with the shaft orifices 33 concentric with the hemispherical ball sockets 31. The pinch plate 27 is superimposed on an angled cam plate 28 that is attached centrally to the power-output shaft 29. Guide rods 35 are extended from circumferential peripheries of the pinch plate 27 into the guide slots 36 in the guide members 37 that are attached to the engine housing 17.

Referring to FIGS. 3–4, the geared threads 22 can have a geared-thread section 39 extended from a cylindrical extension from the linearly-adjustable heads 18. The geared-thread section 39 is rotated by a sun gear 40 with a gear wrench 41. The gear wrench 41 can be designed to engage wrench surfaces such as wrench pins 42 as shown, gear flats or splines on the sun gear 40. The gear wrench 41 can be operated manually or automatically to adjust compression ratio of the combustion envelope 23. With right-handed threading of geared threading 22, all of the plurality of linearly-adjustable cylinder heads 18 are adjusted inwardly to increase compression ratio with decreased volume of the combustion envelope 23 by rotating the gear wrench 41 in a counterclockwise direction. Clockwise rotation of the gear wrench 41 decreases compression ratio. The sun gear 40 can be positioned rotationally on a gear bearing 43 intermediate the power-output shaft 29 and the sun gear 40.

Figure 6:
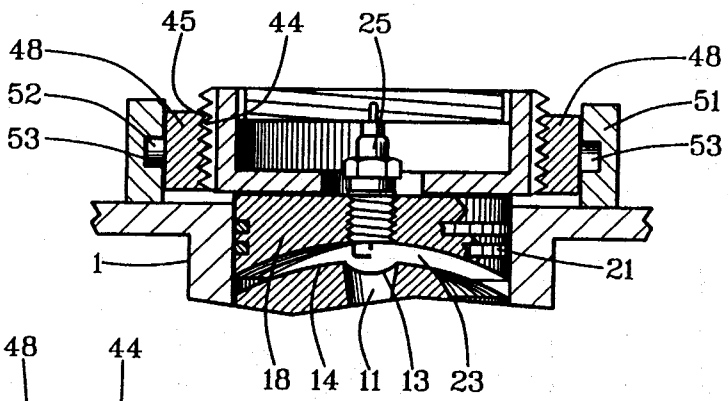
FIG. 6 is a cutaway view of an adjustable cylinder head illustrated in FIG. 5.
Figure 5:
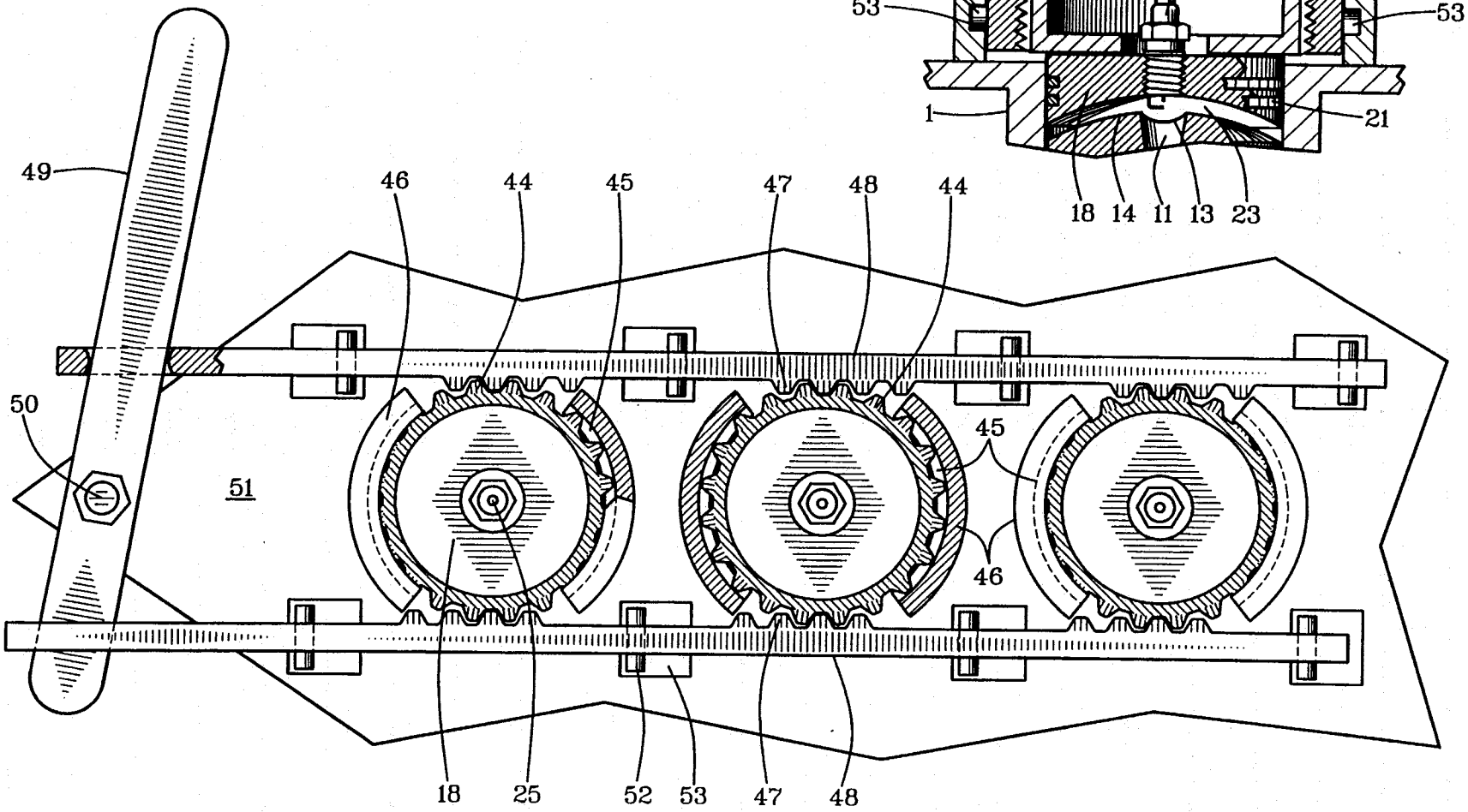
FIG. 5 is a sectional top view of a head section of an in-line-piston engine with geared threading of cylinder heads rotated by a rack gear for adjustment of compression ratio.

Referring to FIGS. 5–6, linearly-adjustable cylinder heads 18 that are positioned in line for in-line-cylinder engines can have full-circle geared threading 44. Teeth of the geared threading 44 engage cylinder threads 45 in arcuate cylinder extensions 46 or attachments with arcuate vacancies for engagement with rack-gear teeth 47 on a rack gear 48 on one or on opposite sides of the linearly-adjustable cylinder heads 18. First and second rack gears 48 can be operated manually or automatically with a rack-gear handle 49 that is pivotal on a gear axle 50 positioned on an in-line-engine housing 51. Guide pins 52 can be extended from the rack gears 48 into pin slots 53 for arresting excessive travel of the rack gears 48. In this example, clockwise rotation of the rack-gear handle 49 increases and counterclockwise rotation decreases compression ratio of the combustion envelope 23 with right-hand threading of the linearly-adjustable cylinder heads 18. A guide pin 52 is shown in a pin slot 53 on a left side but not on a right side of FIG. 6 to indicate appearance and non-appearance of the guide pin 52 at different select cross sections as a result of opposite-directional travel of the rack gears 48. The in-line engine housing 51 is representative of piston relationships for either in-line, V or opposed-piston types of crankshaft engines.

Referring to FIGS. 1 and 5–6, use of the linearly-adjustable cylinder head 18 on crankshaft engines requires pivotal attachment of a connecting rod, not shown, to either the supercharge section 5 of the piston 4 or to the piston shaft 26 in place of the shaft ball 30. A piston shaft 26 reciprocative in a transverse bearing, not shown, proximate a bottom of the supercharge section 2 of the cylinder 1 is preferable to isolate side pressures from the piston 4 if a connecting rod for a crankshaft, not shown, is attached pivotally to the piston shaft 26. Features of crankshaft engines referenced but not shown or otherwise described are considered well-known in the applicable art.

As designed, this invention provides better fuel usage and economy it reburns any fuel left on the next charge. Furthermore, a stratified charge is achieved automatically by this new engine.

A new and useful prime mover having been described, all such modifications, adaptations, applications and forms thereof described by the following claims are included in this invention.

I claim:

1. An internal-combustion engine having:

at least one cylinder with a supercharge section of the cylinder at a supercharge end of the cylinder;

a power section of the cylinder at a power end of the cylinder having a selectively smaller diameter than a diameter of the supercharge section of the cylinder;

a piston having a power section of the piston in sliding-seal contact with inside peripheral walls of the power section of the cylinder and a supercharge section of the piston in sliding-seal contact with inside peripheral walls of the supercharge section of the cylinder;

exhaust ports at an exhaust end of the power section of the cylinder;

a transfer channel positioned circumferentially at an outside periphery of a bottom end of the supercharge section of the cylinder;

a plurality of outlet transfer ports in fluid communication from a low portion of the supercharge section of the cylinder to the transfer channel;

a plurality of inlet transfer ports in fluid communication from the transfer channel to a selectively higher portion of the supercharge section of the cylinder;

a one-way-inlet-valved port in the supercharge section of the cylinder;

an inlet port positioned centrally in a head of the piston;

an intake transfer conveyance within the piston positioned in fluid communication between the supercharge section of the cylinder and the intake port that is positioned centrally in the head of the piston;

an ignition means proximate a head of the cylinder; and rotational power-takeoff means in rotational-power-takeoff relationship to the piston and the cylinder.

2. An internal-combustion engine as described in claim 1 wherein:

the transfer channel has a smaller volumetric size than the supercharge section of the cylinder such that intake air is pre-compressed in the transfer channel and the intake transfer conveyance within the piston has a venturi throat such that intake air is venturi-accelerated from the inlet port in the head of the piston to a top of the power section of the cylinder while exhaust gases are being discharged from a plurality of two-stroke ports positioned circumferentially at a bottom end of the power section of the cylinder.

3. An internal-combustion engine as described in claim 1 and further comprising:

a linearly-adjustable cylinder head of the cylinder; and a means for positioning the linearly-adjustable cylinder head selectively within the power end of the cylinder.

4. An internal-combustion engine as described in claim 3 wherein:

the means for positioning the linearly-adjustable cylinder head is external geared threading on an outside periphery of the linearly-adjustable cylinder head that is rotated by an adjustment gear that is in gear-drive relationship to at least one linearly-adjustable cylinder head, such that actuation of the adjustment gear rotates the linearly-adjustable cylinder head to position the linearly-adjustable cylinder head linearly as desired within internal threading in cylindrical-head walls attached to the cylinder.

5. An internal-combustion engine as described in claim 4 wherein:

the rotational power-take-off means is a cam drive with a plurality of pistons in cylinders positioned circumferentially and the adjustment gear is a sun gear positioned rotatively at a position central to external geared threading on outside peripheries of a plurality of linearly-adjustable cylinder heads, such that rotation of the sun gear rotates the plurality of linearly-adjustable cylinder heads inwardly and outwardly in accordance with selected directional rotation of the sun gear.

6. An internal-combustion engine as described in claim 1 wherein:

the rotation power-take-off means is a cam drive with a plurality of pistons in cylinders positioned circumferentially and having piston shafts extended from the supercharge sections of the pistons with cam-drive means on drive ends of the piston shafts in cam-drive relationship to an angled cam plate on a power-output shaft.

7. An internal-combustion engine as described in claim 6 wherein:

the cam-drive means on drive ends of the piston shafts is a pinch plate in sliding contact with the angled cam plate attached centrally to an output shaft;

hemispherical ball sockets are positioned concentrically to the piston shafts of the plurality of pistons in the pinch plate;

shaft balls on drive ends of the piston shafts are positioned in the hemispherical ball sockets;

a retainer plate having shaft orifices with diameters smaller than diameters of the shaft balls and larger than diameters of the piston shafts is positioned on a piston side of the pinch plate, such that the pinch plate functions as a cam-drive plate for the plurality of pistons in cam-drive relationship to the angled cam plate.

8. An internal-combustion engine as described in claim 3 and further comprising:

a sliding-seal means in sliding-seal relationship between the linearly-adjustable cylinder head and the cylinder.

9. An internal-combustion engine as described in claim 4 and further comprising:

a sealing section of the linearly-adjustable cylinder head extended into the power end of the cylinder and having a sliding-seal means in pressure-sealing relationship between the linearly-adjustable cylinder head and the power end of the cylinder.

10. An internal-combustion engine as described in claim 7 and further comprising:

a pinch-plate-guide means in centrally-positioning relationship to the pinch plate.

11. An internal-combustion engine as described in claim 10 wherein:

the pinch-plate guide means is a plurality of guide rods extended radially from the pinch plate into guide slots in guide members positioned circumferentially to wobbling travel of the pinch plate.

12. An internal-combustion engine as described in claim 1 wherein the rotation power-take-off means is a cam drive having:

a first plurality of pistons in cylinders positioned circumferentially and having piston shafts extended from the supercharge sections of the pistons with cam-drive means on drive ends of the piston shafts in cam-drive relationship to a first angled cam plate positioned centrally on a power-output shaft; and a second plurality of pistons in cylinders positioned circumferentially and having piston shafts extended from the supercharge sections of the piston with cam-drive means on drive ends of the piston shafts in cam drive relationship to a second angled cam plate positioned centrally on the power-output shaft at an equal angle from perpendicularity to the power-output shaft as the first angled cam plate.

13. An internal-combustion engine as described in claim 12 wherein;

the cam-drive means is a first pinch plate having sliding contact with the first angled plate and a second pinch plate having sliding contact with the second angled plate;

piston shafts are extended from the supercharge sections of the first plurality of pistons and from the second plurality of pistons with axes of the first plurality of pistons and axes of the second plurality of pistons positioned concentrically at respective opposite sides of the first angled cam plate and the second angled cam plate;

hemispherical ball sockets are positioned concentrically to the piston shafts of the first plurality of pistons in the first pinch plate;

hemispherical ball sockets are positioned concentrically to the piston shafts of the second plurality of pistons in the second pinch plate;

shaft balls on drive ends of the piston shafts are positioned pivotally in the hemispherical ball sockets;

retainer plates having shaft orifices with diameters smaller than diameters of the shaft balls and larger than diameters of the piston shafts are positioned on piston sides of the first pinch plate and the second pinch plate with the shaft orifices concentric with the hemispherical ball sockets, such that the first and second pinch plates function as cam-drive plates for the first and second plurality of pistons in double-acting relationship with flat surfaces of first and second pinch plates in cam-drive relationship to the first and second angled plates.

14. An internal-combustion engine as described in claim 13 and further comprising:

a pinch-plate-guide means in centrally-positioning relationship to the first pinch plate and to the second pinch plate.

15. An internal-combustion engine as described in claim 14 wherein:

the pinch-plate guide means is a plurality of guide rods extended radially from the first pinch plate and from the second pinch plate into guide slots in guide members positioned circumferentially to wobbling travel of the first pinch plate and the second pinch plate on the first angled plate and on the second angled plate respectively.

* * * * *